United States Patent [19]

Saville

[11] 4,295,881

[45] Oct. 20, 1981

[54] PROCESS FOR EXTRACTION OF PLATINUM GROUP METALS FROM CHROMITE-BEARING ORE

[75] Inventor: James Saville, Stamford, Conn.

[73] Assignee: Texasgulf Inc., Stamford, Conn.

[21] Appl. No.: 158,184

[22] Filed: Jun. 10, 1980

Related U.S. Application Data

[63] Continuation of Ser. No. 38,820, May 14, 1979, abandoned, which is a continuation-in-part of Ser. No. 32,680, Apr. 23, 1979, abandoned.

[51] Int. Cl.[3] ..... C22B 4/04

[52] U.S. Cl. ..... 75/10 R; 75/83; 75/121

[58] Field of Search ..... 75/10 R, 83, 121

[56] References Cited

U.S. PATENT DOCUMENTS

| | | | |
|---|---|---|---|
| 1,841,207 | 1/1932 | Powell et al. | 75/83 X |
| 3,304,169 | 2/1967 | Death et al. | 75/83 X |
| 3,783,167 | 1/1974 | Tylko | 13/1 |
| 3,920,789 | 11/1975 | Pittie et al. | 75/121 X |
| 4,135,923 | 1/1979 | Day | 75/83 X |
| 4,188,362 | 2/1980 | Edwards | 75/121 X |

FOREIGN PATENT DOCUMENTS

| | | | |
|---|---|---|---|
| 328564 | 4/1930 | United Kingdom | 75/83 |
| 1481295 | 7/1977 | United Kingdom | 75/83 |

*Primary Examiner*—M. J. Andrews
*Attorney, Agent, or Firm*—Denis A. Polyn

[57] ABSTRACT

A process for treating chromite-bearing ores to obtain useful mineral values, especially platinum group metal, therefrom wherein the ore is separated into magnetic and non-magnetic fractions; the non-magnetic fraction, containing a substantial portion of the platinum group metals, is concentrated and smelted to produce a metal layer containing platinum group metals; and the platinum group metals are then substantially disassociated from the metal layer containing them. The magnetic fraction of the ore may itself be further treated to remove any platinum group metals associated therewith.

18 Claims, 5 Drawing Figures

PROCESS FOR EXTRACTION OF PLATINUM GROUP METALS FROM CHROMITE-BEARING ORE

This is a continuation of application Ser. No. 38,820, filed May 14, 1979 now abandoned, which is in turn a continuation-in-part of Ser. No. 32,680, filed on Apr. 23, 1979 and is now abandoned.

BACKGROUND OF THE INVENTION

This invention relates to the separation and beneficiation of minerals and, in particular, to the treatment of chromite-bearing ores which contain platinum group metals in order to recover the platinum group metals in a form suitable for separation into individual metals and purification of these metals. In addition to platinum group metals, other metals such as nickel, copper, cobalt if present in the ore as native metals or compounds thereof, can be recovered in a form suitable for further purification. The chromite in the ore also may be recovered for further treatment and use.

Chromite ore, which varies compositionally within wide limits permitted by the formula (Mg, $Fe^{2+}$) (Cr, Al, $Fe^{3+})_2O_4$, is mined extensively in the Republic of South Africa, Rhodesia, U.S.S.R., Turkey, Iran, India, Brazil, Albania, Finland and the Philippines. Chromite is the only commercial mineral occurrence of chromium and it is used for production of chromium metal, chromium chemicals, foundry sands, refractory materials and ferroalloys such as ferrochrome. Typically chromite occurs as stratiform or podiform deposits associated with ultramafic igneous rocks.

Platinum group metals, which include platinum, palladium, rhodium, ruthenium, iridium and osmium, are sometimes found in association with chromite-bearing ores at chromite grain boundaries, within chromite grains or in the gangue material associated with the ore and they are usually also associated with sulphides of nickel, copper and iron. Platinum group metals are of significant industrial value finding application, for example, as catalytic or inert materials in many chemical reactions. They are used extensively in the petroleum taining platinum group metals is treated by this method, the chromite interferes with the process and causes losses of platinum group metals and accretions in the furnace.

It appears that chromite reacts with the carbon electrode material to form ferrochrome which alloys with the platinum group metals and from which the platinum group metals cannot be readily extracted. In addition, chromite particles remote from the electrodes appear to settle out on the furnace walls and hearth forming accretions which interfere with smooth operation of the furnace.

SUMMARY OF THE INVENTION

It is an object of the present invention to describe a process for the treatment of chromite-bearing ores to recover useful mineral values therefrom.

A further object of the invention is to describe a process for the treatment of chromite-bearing ores to recover platinum group metals therefrom. In the course of this description a process is described to recover nickel, copper and cobalt from the ore if these metals or minerals thereof occur together with platinum group metals.

These and other objects are achieved by the provision of a process which comprises the steps of: comminuting the chromite-bearing ore containing one or more platinum group metals associated therewith; subjecting the comminuted ore to wet high intensity magnetic separation to form separate magnetic and non-magnetic fractions wherein the non-magnetic fraction contains a substantial portion of the platinum group metals contained in the ore; subjecting the non-magnetic fraction to a flotation process to form a flotation concentrate containing, inter alia, platinum group metals or compounds thereof; smelting the flotation concentrate, in the presence of added collector materials for the platinum group metals, in a high intensity heating furnace to form a slag layer and a layer containing collector material and platinum group metals; separating the collector material layer from the slag layer; and separating the platinum group metals from the collector material.

In accordance with a preferred embodiment of the present invention, a process is described wherein, inter alia, the magnetic fraction resulting from wet high intensity magnetic separation is itself treated to recover platinum group metals which may be associated therewith. This process comprises the steps of: comminuting the chromite-bearing ore containing one or more platinum group metals associated therewith; subjecting the comminuted ore to single or multiple stage wet high intensity magnetic separation to form separate magnetic and nonmagnetic fractions wherein the nonmagnetic fraction contains a substantial portion of the platinum group metals contained in the ore; subjecting the magnetic fraction, which contains a substantial portion of the chromite contained in the ore, to gravity separation in a flowsheet incorporating comminution and reseparation of composite particles of chromite and gangue and subjecting the tailings to either comminution and flotation of the sulphides of iron and other magnetic sulphides with which the platinum group metals may be associated, or comminution and further gravity concentration of the platinum group metals particles, or subjecting the tailings to wet high intensity magnetic separation in order to separate résidual chromite in the tailings from the nonmagnetics; adding these nonmagnetics to the nonmagnetics produced from the original ore; subjecting the combined nonmagnetics product or nonmagnetics from original ore to which has been added flotation or gravity concentrates produced from the aforesaid tailings resulting from gravity separation of the chromite magnetics to comminution and a flotation process to form a concentrate containing inter alia platinum group metals or compounds thereof; adding collector materials for the platinum group metals, activators to improve the collection efficiency and appropriate fluxes and smelting these materials and concentrates in a high intensity heating furnace to form a slag layer and a layer consisting of the collector material, platinum group metals and nickel, copper and cobalt if they were present in the concentrates smelted in the furnace; removing the liquid slag and collector material together or separately from the furnace; separating the collector material layer from the slag layer and cooling the collector material and slag; separating the platinum group metals and nickel, copper and cobalt, if present, from the collector material by leaching it with a mineral acid followed by separation from the leach solution of nickel, copper and cobalt and also the collector material if it is economically justified, with the platinum group metals forming an insoluble residue or gel within the leaching vessel; separating and refining the individual platinum group metals from the residue or gel by well-known industrial methods; subjecting the slag to granulation, comminution and gravity separation of metal particles, if it is found that recovery of entrained particles is economically justified, and adding the metal particles to the collector materials, activators, fluxes and concentrates before smelting or else adding the metal particles to the leacing vessel used for separating the platinum group metals from the collector material and other metals present in the ore.

DETAILED DESCRIPTION OF THE INVENTION

Figure 1:
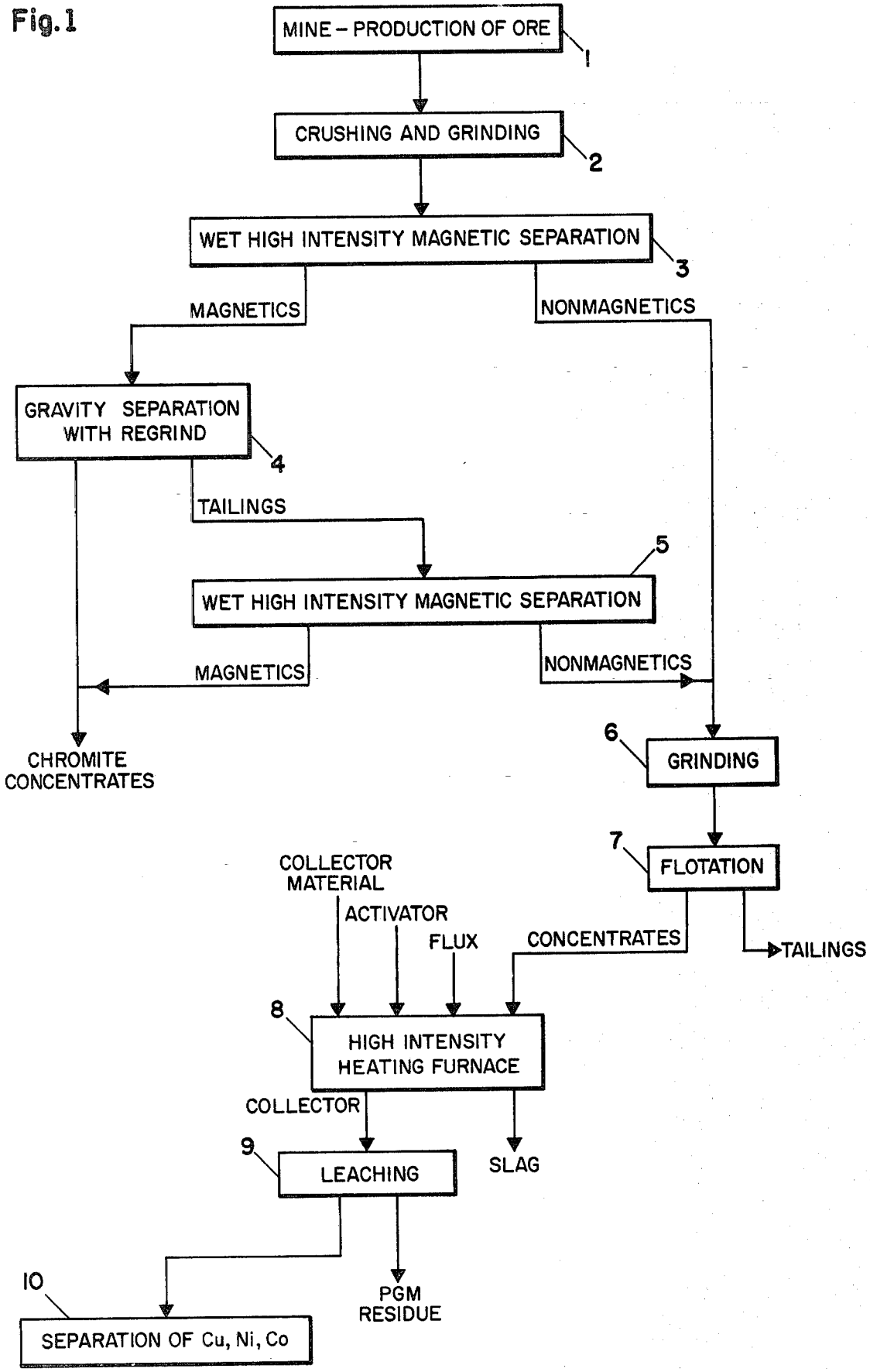
FIG. 1 is a schematic flowsheet of the overall process of the present invention wherein platinum group metals and chromite are recovered from chromite bearing ore.

With reference to FIG. 1, chromite bearing ore containing platinum group metals is mined at 1 by suitable methods and is comminuted at 2 to a sizing suitable for liberation of the chromite grains from gangue and additionally suitable for the magnetic separation which follows. For example, a South African ore was crushed and ground using a conventional ball mill circuit with recirculation of oversize particles to a sizing whereby substantially all of the particles of the ore were able to pass through a 60 mesh ASTM (250u) screen. A typical sizing for the ground ore was as follows:

| Screen Sizing | | Sizing Distribution |
|---|---|---|
| Mesh ASTM | Microns | Weight % Passing |
| 60 | 250 | 100 |
| 100 | 150 | 77 |
| 140 | 105 | 47 |
| 200 | 74 | 34 |
| 400 | 37 | 16 |

The comminuted ore is then subjected to wet high intensity magnetic separation at 3 in order to separate the magnetic chromite particles from the nonmagnetic gangue particles which contain a substantial portion of the platinum group metals in the ore. In the wet high intensity magnetic separation process a thoroughly mixed slurry of the comminuted ore and water is subjected to a magnetic flux while the slurry is passing through a vessel containing metallic media such as grooved plates, steel wool or balls shaped to intensify the magnetic flux perpendicular to the flow direction of the slurry. The magnetic particles, chromite, are retained on the media and the nonmagnetic gangue particles pass through the vessel. Intermittently the flow of slurry to the vessel is stopped, the magnetic material adhering to the media is washed to remove entrained nonmagnetics and weakly magnetic particles and then the magnetic field is removed, permitting the magnetic particles to be washed from the media. The magnetic field is restored and the slurry is again passed through the vessel in the same series of steps. This intermittent cycle is conveniently automated by fabricating the vessels as annular segments of a ring which rotates continuously perpendicular to fixed electromagnets located around the periphery of the ring.

A suitable wet high intensity magnetic separator is the Jones Ferromagnetics Separator manufactured by K.H.D. Industrieanlagen AG, Cologne, Federal Republic of Germany. In such a separator, which is of the ring type construction, magnetic particles in a slurry passing through the separator are attracted within the magnetic field to the surface of grooved vertical plates located in the vessel with the grooves parallel to the direction of slurry flow. The spacing of the plates and number of grooves per inch on the plates can be altered and optimised for recovery of magnetics for each particular ore. The magnetic fraction adhering to the plates is washed with water while the plates are in the magnetic field to remove entrained nonmagnetic and weakly magnetic particles. The magnetic particles are then washed from the plates when they enter a zone of zero magnetic flux.

Depending upon the nature of the ore, one or more passes of magnetics or nonmagnetics through the magnetic field may be necessary to obtain high efficiency of separation. The wash water which contains weakly magnetic particles may be recirculated. For a South African ore, using slurry pulp densities of 10 to 30% solids by weight, two passes of non-magnetics plus wash water were necessary as shown in 21 and 22 of FIG. 3 with different plate spacings for the first and second pass. In this case, the weight recovery of magnetics was between 75 and 80% with chromium recovery to magnetics of 95 to 97% by weight. The recovery of platinum group metals to nonmagnetics was 65 to 70% by weight.

The distribution of platinum group metals between the magnetics and nonmagnetics fraction is, to a large extent, dependent upon the mineralogy of the platinum group metals in the ore. For example, in a South African ore, about 10% of the platinum group metals particles were locked inside chromite particles and about 90% of the particles were located in the gangue, where they were found sometimes at chromite grain boundaries and often associated with nickel and copper sulphides. The platinum group metal particles may be magnetic, such as iron bearing platinum.

Figure 3:
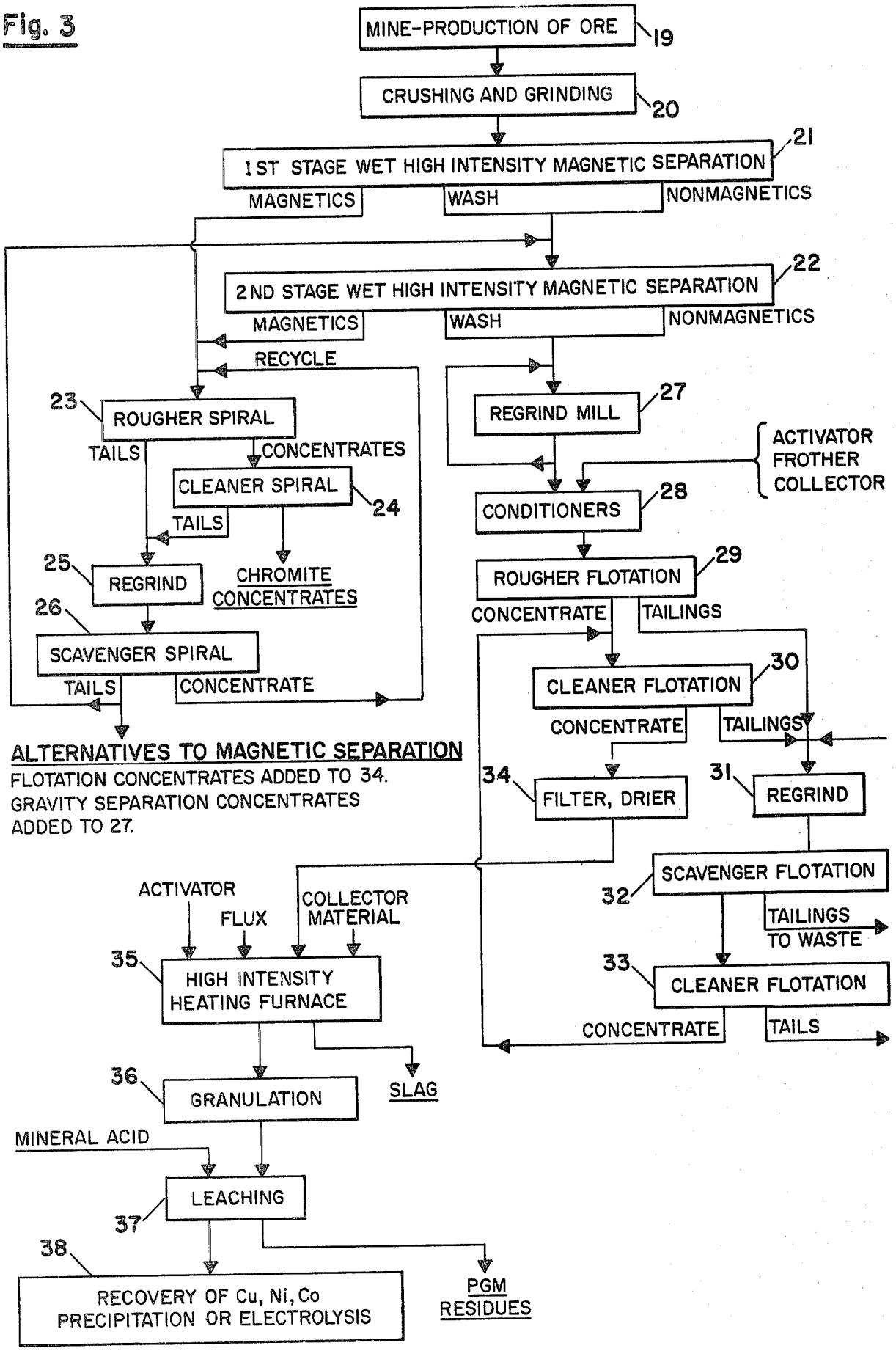
FIG. 3 is a schematic flowsheet of a method used for processing of a South African chromite-bearing ore containing platinum group metals in order to produce chromite concentrates, residues containing platinum group metals and nickel, copper and cobalt as metals or compounds suitable for further purification processes. Three alternative methods for treatment of magnetics product after upgrading by spirals are indicated with the tailings being returned to different locations in the flowsheet.

In order to obtain a higher recovery of platinum group metals from the ore, the magnetics product may be processed further by gravity separation methods at 4 in FIG. 1. It has been found advantageous when processing a South African ore to pass the magnetics product through a spirals gravity separation circuit consisting of a rougher stage at 23 in FIG. 3, one or more cleaner stages at 24 and a scavenger stage 26 for rougher and cleaner tails with a regrind stage at 25 before the scavenger. The scavenger concentrate returns to the rougher feed for reprocessing. The scavenger tails, which contain a considerable portion of the platinum group metals reporting to the magnetics product, may be further processed for concentration of platinum group metals by means of flotation, wet high intensity magnetic separation for removal of residual chromite particles or by gravity methods such as tabling. In the case of wet high intensity magnetic separation, the tailings material may be added to the feed to the second stage of magnetic separation as shown in FIG. 3.

In additional advantage of processing the magnetics product by gravity separation methods is the removal of siliceous gangue material from the chromite which enhances its value. For example, the silica ($SiO_2$) content of chromite used in production of chromium chemicals should be lower than 2% and preferably lower than 1% to minimize losses of fluxing agents.

The nonmagnetic product from 3 in FIG. 1, together with nonmagnetics product from gravity concentration of magnetics product at 5 in FIG. 1, if that is the method used to upgrade the gravity tailings, contains a substantial portion of the platinum group metals present in the ore. This material is subjected to a flotation process 7 in FIG. 1, designed to separate sulphides from the gangue material, thus further concentrating the platinum group metals present as sulphides, or associated with sulphides of copper and nickel and iron.

Depending upon the degree of sub-division of the nonmagnetic product from the magnetic separator, it may be necessary to grind the nonmagnetic product at 6 before flotation in order to achieve rapid and efficient flotation. For a South African ore the optimum sizing for flotation was found to be such that about 80% of the particles pass through a 200 mesh ASTM (74u) screen. In addition, a continuous discharge centrifuge may be employed after the grinding at 6 and prior to flotation at 7 in order to pre-concentrate the platinum group metals before flotation.

The flotation circuit may be any such circuit suitably designed and optimised for upgrading such materials, including subjecting the nonmagnetic fraction to a series of flotations in rougher, cleaner, recleaner and scavenger cell banks with the addition of suitable conditioners and pH modifiers such as copper sulphate, sulphuric acid, sodium hydroxide, frothers such as cresylic acid, Flotanol F, and collectors such as sodium isobutyl xanthate.

A typical flotation flowsheet is shown in FIG. 3. The subdivided nonmagnetic fraction is reground at grinding mill 27 in closed circuit with a particle size separation device such as a hydrocyclone, spiral screw classifier or screen, in order to achieve a particle size distribution adequate to liberate the sulphide and platinum group metals particles. The particles which are coarser than the desired sizing are returned to the feed to the mill for regrinding.

It may be advantageous to deslime the slurry produced by the mill before sending it to flotation. A South African ore was deslimed at about 10 microns using hydrocyclones and this enhanced the recovery of platinum group metals in subsequent flotation of the deslimed ore. Recoveries of about 80% to 90% of platinum group metals in the deslimed ore were achieved by flotation. The slimes may contain a considerable portion of the platinum group metals in the nonmagnetics feed to the grinding mill 27. For a South African ore, about 18% of the ground ore was removed as minus 10 micron slimes and this slime contained about 15% of the platinum group metals in the feed to the desliming hydrocyclone. Consequently, the slime should be recovered for smelting by thickening and spray drying of the thickened slimes and blending it with flotation concentrates produced from the deslimed nonmagnetics.

The pulp density of the slurry of suitably sized particles is adjusted to a density suitable for effective mixing and conditioning of the particles with the flotation reagents, conditioners, frothers, collectors previously described, and after further density adjustment to the optimum value for flotation it is subjected to flotation in the bank of rougher cells 29. The concentrate from this bank of cells is thereafter admitted to a bank of cleaner cells 30 for final concentration. The tailings material, which is depleted in content of platinum group metals, is densified and sent to a regrind mill 31 which may be operated in open circuit without particle size control, in order to liberate composite particles in which the platinum group metals, sulphides and gangue are intergrown. A typical sizing of product from the regrind mill is 100% less than 200 mesh ASTM (74u).

The pulp density of the product from the regrind mill is adjusted to the optimum value for flotation and additional reagents, such as frothers and collectors, may be added before scavenger flotation at 32. The concentrate from the scavenger cells is sent to a bank of cleaner cells 33 for further upgrading. The tailings from the scavenger flotation cells is discharged to a tailings pond for recovery and recirculation of water.

The concentrate from cleaner cells 3 is sent to mix with the concentrate produced from rougher cells 29 before refloating in the cleaning flotation cells at 30. The tailings from cleaner cells 33 and cleaner cells 30 are sent to join the tailings from rougher cells 29 before regrinding at 31.

The final concentrate from cleaner flotation cells 30, which contains a substantial portion of the platinum group metals in the nonmagnetics fraction, is then filtered and dried at 34 before smelting at 8 in FIG. 1 and 35 in FIG. 3.

Figure 2:
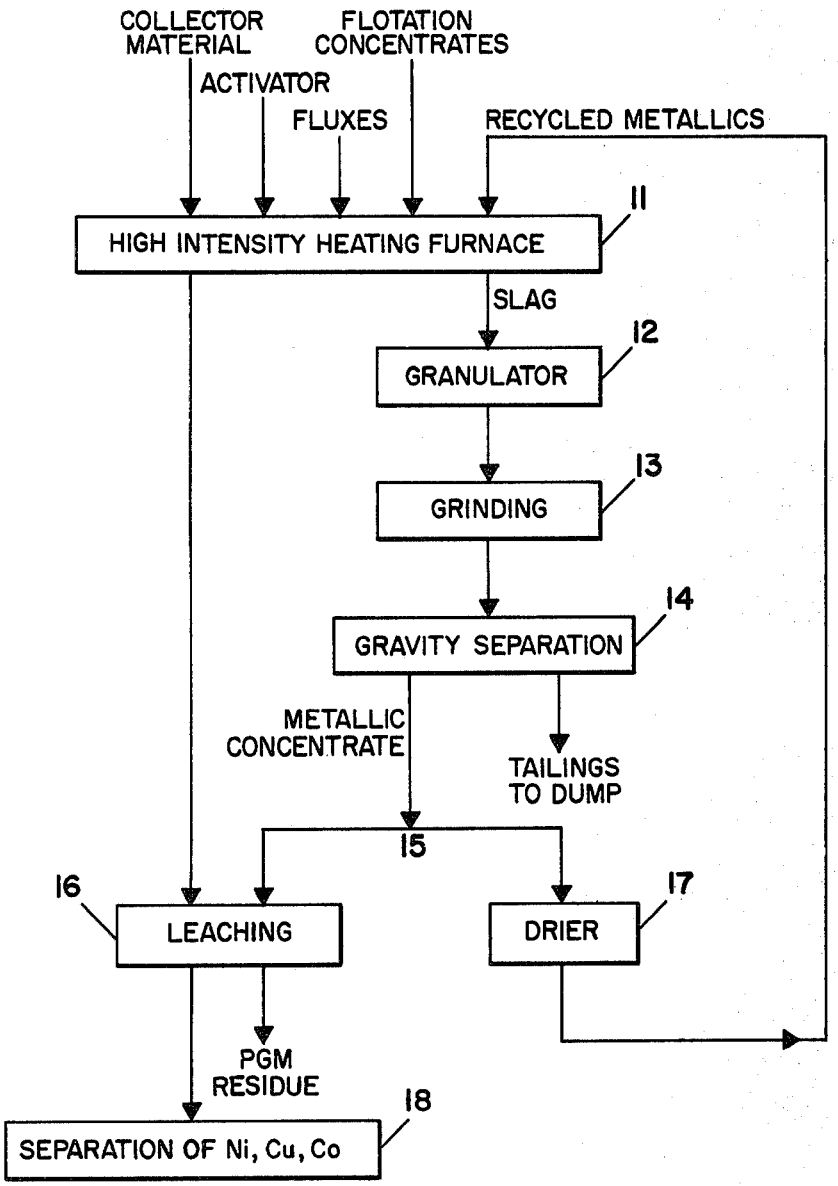
FIG. 2 is a schematic flowsheet of alternative methods of processing the slag from the high intensity heating furnace if this appears to be economically justified, i.e., leaching it together with the collector material or drying it and recycling it to the furnace remelting.

The purpose of smelting the flotation concentrates in the high intensity heating furnace 11, shown in FIG. 2, together with fluxes, collector material and activator, is to produce a metal layer comprised of platinum group metals, and nickel, cobalt and/or copper if contained in the ore, and a collector or collectors therefor and a slag layer comprised of residual materials from the flotation concentrates, slimes and fluxes added to produce a fluid slag with a low melting point.

A preferred high intensity heating furnace is a plasma arc furnace, for example, using an expanded precessive plasma arc apparatus manufactured by Tetronics Research and Development Co. (see, for example, U.S. Pat. No. Re. 28,570 of Oct. 14, 1975). In such furnaces, one or more of such plasma devices are utilized to melt powered feed materials containing platinum group metal concentrates and appropriate powdered collectors, fluxes and other reagents to obtain separate fluid slag and metallic layers which may be separately removed from the surface. The sizings of the feed particles should be below 100 mesh ASTM (150u) so that there will be adequate mixing of the different components.

An important feature of the present invention is the discovery that the process described herein is much less sensitive to the presence of chromite in the heating furnance than is the case with known smelting techniques for the extraction of platinum group metals from ores. In these techniques the presence of as little as 1.0% by weight of chromite in the concentrate fed to the submerged arc carbon electrode furnace, in the known method earlier described, can cause problems with recovery of platinum group metals. The process of the present invention can tolerate at least 7% chromite in the feed to the heating furnace without encountering such difficulties. Thus the magnetic separation process need not achieve the nearly complete removal of all the chromite from the ore which would be required for adapting the prior available smelting and extraction methods to the ore. On the other hand, since the chromite in the flotation concentrate and slimes fed to the smelter reports to the slag layer and may increase the slag viscosity which affects platinum group metals recovery, and since chromite is unrecoverable from the slag for commercial use, it is advantageous to maximize the recovery of chromite into the magnetic fraction.

The high intensity heating furnace for use in the present invention should be such that uncontrolled amounts of carbon or carbonaceous materials do not come in contact with any chromite present in the feed to the furnace since the resultant ferrochrome which may form, as earlier noted, seriously impairs the recovery of platinum group metals. Thus either no carbon should be present in the furnace refractory lining or construction, or, if present, should be suitably protected against the possibility of contact with chromite at high temperatures above about 1100° C.

The presence of a small amount of carbon or sulphur in the feed to the furnace has been found beneficial in obtaining good recovery of collector metal and platinum group metals. The effect of carbon or sulphur, termed activators, is to scavenge residual oxygen in the feed powers and ensure a neutral or slightly reducing atmosphere in the furnce. The amount of carbon or sulphur found useful for this purpose is between about 0.5 and 3.0% by dry weight of platinum group metal containing concentrates and slimes admitted to the furnace.

In the process of the present invention, high intensity heating is performed in the presence of one or more metals which have been found to be efficient collectors for the platinum group metals. Such collector metals may include copper, nickel, cobalt, iron, lead and zinc metals or mixtures thereof or any other suitable metal to which platinum group metals will report during a smelting process. Additionally, the collector material(s) should be chosen such that the eventual recovery of platinum group metals therefrom is not exceptionally difficult or uneconomical. For example, ferrochrome is known to be a good collector for platinum group metals but separation of the platinum group metals from the ferrochrome is very difficult and is probably uneconomic.

Some of the collector metals noted above may also be admitted to the furnace in the form of their oxides or hydroxides or other compounds if they are suitable for reduction to metal in the furnace with carbonaceous reductants. Although the adverse effect of carbon on reduction or chromite in the smelting proces has previously been described, careful control of the amount of reductant carbonaceous material introduced with the feed may ensure that there is no carbonaceous material after the preferential reduction of the collector metal oxides, hydroxides or other compounds.

Typically, the collector material will be present in an amount between about 3% to about 10% by dry weight of the platinum group metal-containing flotation concentrates and slimes admitted to the furnace. For a cncentrate produced from a South African ore which contains about 5% chromite in the feed to the furnace, 3% copper or iron powder or 5% hematite iron ore fines with appropriate carbonaceous reductant may be used.

The collector metals may be introduced into the furnace either by mixing them with the flotation concentrate prior to entry to the furnace or by separately melting these materials, either inside or outside the furnce, to provide a liquid layer thereof in the furnce prior to introduction of the flotation concentrate. It may be convenient in industrial practice that continuous feed of platinum group metal containing concentrates to the furnace contain lesser amounts of added collector material therewith so that the collector material liquid layer in the furnace becomes continually enriched with platinum group metals to a concentration particularly suited for further treatment of collector material for recovery of platinum group metals.

Fluxes may also be added to the smelting furnce to control or alter the viscosity, melting temperature and basicity of the resultant slag layer. Suitable flux materials, for example, are lime and dolomite. A typical slag has a melting point in the range of about 1100° C. to about 1300° C. and has a mineral composition of the type forsterite, pyroxenite, melilite. In addition, other minerals may form, such as magnesiochromite. It is important to obtain a low slag viscosity in order to achieve rapid settling and efficient separation of the small particles of platinum group metals and collector metals.

Upon suitable separation into fluid slag and metal layers within the high intensity heating furnace, the slag layer is tapped and further processed for disposal as shown in FIG. 2. Depending upon the efficiency and economics of the overall process, it may in some instances be desirable to granulate at 11 and grind the slag at 13 then concentrate small particles of platinum group metals and collector metal from slag by gravity separation techniques at 14 and remelt them with platinum group metal concentrates with appropriate collectors to recover the residual platinum group metals therein as shown in FIG. 2 or else send the particles to leaching 16 with the metallic layer from the furnace.

The metallic layer, containing the metal collector in association with the substantial portion of the platinum group metals originally admitted via the flotation concentrate and slimes, is then removed from the furnace and further processed to recover the platinum group metals or mixtures thereof. For example, in FIG. 3, the metal layer may be granulated at 36 and then subjected to acid leaching at 37 whereby the metal layer is dissolved in acids such as sulfuric, nitric, hydrochloric or mixtures thereof, and the platinum group metals precipitate and/or form colloids and are separated by filtration as an insoluble sludge. The dissolved metal may then be further treated, if economical, at 37, e.g., by electrolysis, to recover from the acid solution, collector metal and other metals such as nickel, copper and cobalt which may occur in small quantities in the concentrate feed. The collector metal may be recycled to the furnace for reuse as a collector. The remaining acid leach solution may also be further purified, e.g., by utilization of gaseous, liquid or solid reductants, to remove any residual platinum group metals dissolved therein.

Alternatively, the metallic layer from the furnace may be cast into plates and treated directly by electrolysis to remove collector material and leave a platinum group metal-containing sludge. In either case, the platinum group metal-containing sludge(s) from processing of the metallic layer are then treated in a known manner to recover either a single metal or metals or a mixture thereof.

The process of the present invention is further illustrated by the following non-limiting examples.

EXAMPLE ONE

Chromite-bearing ore containing approximately 5 grams per tonne of platinum group metals was comminuted, and subjected to wet high intensity magnetic separation using a Jones Ferromagnetics Separator with two passes of non-magnetics. Assays for platinum and palladium are presented as these represent approximately 50% and 25% respectively of the platinum group metal content of the particular ore.

| | | Assays | | | Recoveries % | | |
|---|---|---|---|---|---|---|---|
| Product | wt% | $Cr_2O_3$% | Ptg/t | Pdg/t | $Cr_2O_3$ | Pt | Pd |
| magnetics pass 1 | 62.2 | 39.27 | 1.1 | 0.5 | 80.3 | 21.9 | 20.4 |
| magnetics pass 2 | 14.1 | 33.27 | 2.7 | 1.2 | 15.4 | 12.2 | 11.1 |
| magnetics 1 + 2 | 76.3 | 38.17 | 1.4 | 0.6 | 95.7 | 34.1 | 31.5 |
| non-magnetics pass 2 | 23.7 | 5.47 | 8.7 | 4.4 | 4.3 | 65.9 | 68.5 |
| calc. head assay | 100.0 | 30.41 | 3.1 | 1.5 | — | | |
| actual head assay | — | 30.70 | 3.1 | 1.6 | — | | |

The slurry pulp density was 30% solids (wt.) to the first pass and 20% solids (wt.) to the second pass. The magnetic field strength was 1.0 tesla for both passes.

EXAMPLE TWO

Figure 4:
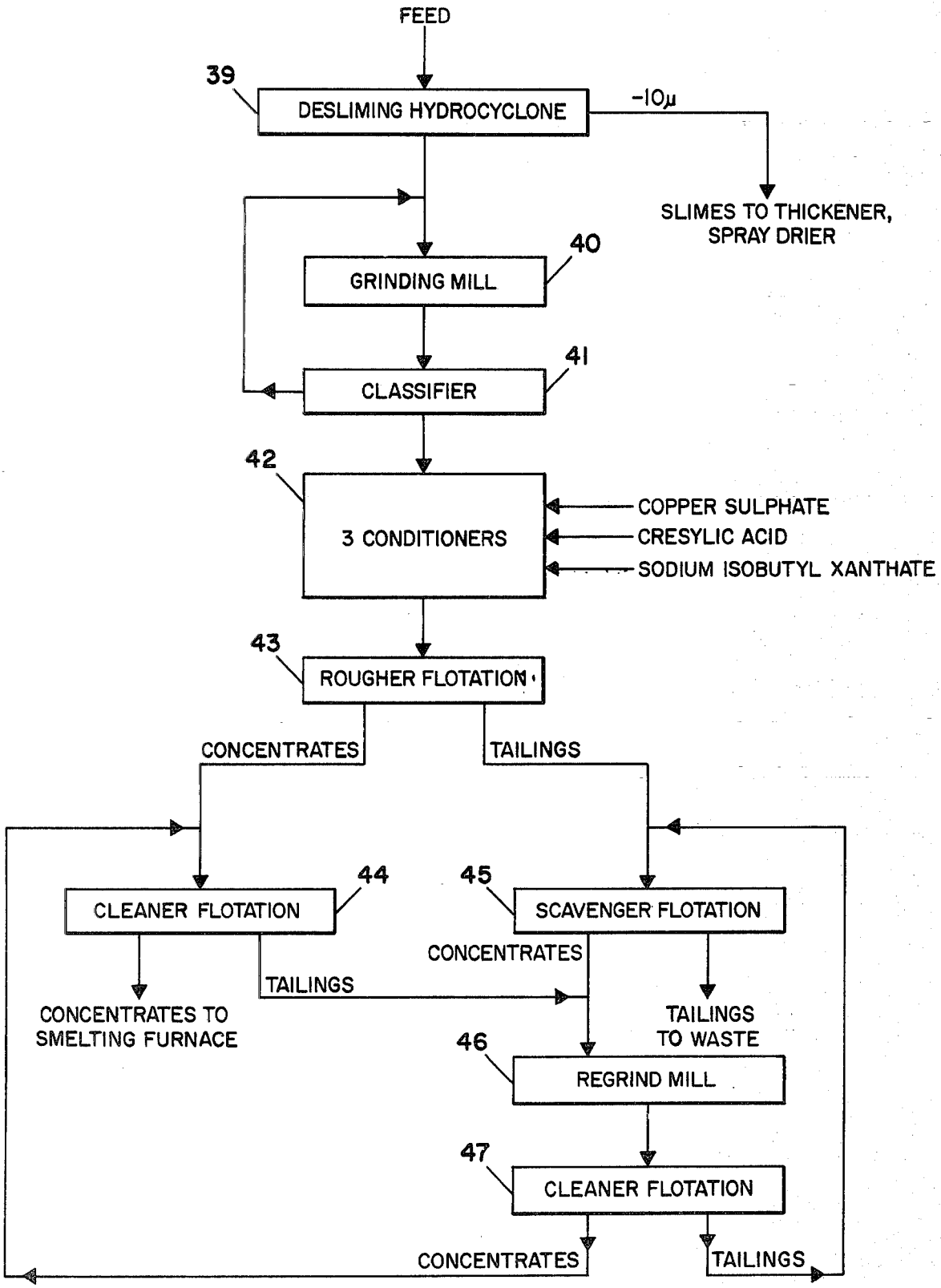
FIG. 4 is a schematic flowsheet of the flotation upgrading system described in Example Two.

Nonmagnetics produced by wet high intensity magnetic separation were processed in a pilot flotation plant according to the flowsheet shown in FIG. 4. The feed ore was deslimed at 39 at 10 microns and the deslimed ore was ground at 40 to 80% minus 200 mesh ASTM using a classifier at 41 consisting of a hydrocyclone and screen in closed circuit with the mill. The ground ore was adjusted to a pulp density of approximately 50% solids and conditioner reagents were added to three stirred conditioner tanks, 42, in series. The conditioning times were 10 minutes with 100 grams per ton of copper sulphate (hydrated basis), 4 minutes with 100 grams per ton of cresylic acid, 3 minutes with 100 grams per ton of sodium isobutyl xanthate. The conditioned pulp was diluted to 30% solids by weight at a pH of 8.5 and was sent to rougher flotation cells 43 for 15 minutes of flotation. The concentrates from rougher flotation were sent to cleaner flotation cells 44 for 10 minutes of flotation. The tailings from the rougher flotation were sent to scanvenger flotation cells 45 for 25 minutes of flotation and the tailings from scavenger flotation were discharged as waste. The concentrates from scavenger flotation were sent to a regrind mill 46 together with tailings from the cleaner flotation cells 44. The product from the regrind mill which was 100% minus 200 mesh ASTM was sent to cleaner flotation cells 47 for 10 minutes flotation. The concentrates from cleaner flotation cells 47 were sent to comingle with the concentrates from rougher flotation cells 43 before being sent to cleaner flotation cells 44. The tailings from cleaner flotation cells 47 were sent to comingle with the tailings from rougher flotation cells 43 before being sent to the scavenger flotation cells 45. The concentrates from cleaner flotation cells 44 were final concentrates and were filtered and dried before mixing with the slimes produced from desliming hydrocyclone 39.

DESLIMING HYDROCYCLONE

| | | Assays | | Distribution % | |
|---|---|---|---|---|---|
| Product | wt% | Pt g/t | Pd g/t | Pt | Pd |
| underflow | 82.3 | 8.9 | 4.1 | 85.2 | 84.5 |
| overflow | 17.7 | 7.2 | 3.5 | 14.8 | 15.5 |
| head | 100.0 | 8.6 | 4.0 | 100.0 | 100.0 |

FLOTATION OF DESLIMED NONMAGNETICS

| | | Assays | | Distribution % | |
|---|---|---|---|---|---|
| Product | wt% | Pt g/t | Pd g/t | Pt | Pd |
| concentrates | 14.5 | 47.0 | 23.9 | 79.2 | 80.2 |
| tailings | 85.5 | 2.1 | 1.0 | 20.8 | 19.8 |
| calc. head | 100.0 | 8.6 | 4.3 | 100.0 | 100.0 |
| assayed feed | | 8.8 | 4.2 | | |

EXAMPLE THREE

Flotation concentrates containing 32 grams/ton platinum, 17.5 grams/ton palladium and 7.8% $Cr_2O_3$ were mixed with lime, copper powder and carbon in the weight proportions 72/19/7.5/1.5 and heated in a high intensity gas fired furnace at 1500° C. A metal phase was separated from a slag phase and the weight distribution and assays of the products were as follows:

| | | Assays | | Distribution % | |
|---|---|---|---|---|---|
| Product | wt% | Pt g/t | Pd g/t | Pt | Pd |
| metal | 2.77 | 260 | 115 | 46.0 | 45.0 |
| slag | 97.23 | 8.7 | 4.0 | 54.0 | 55.0 |
| calc. head | 100.00 | 15.7 | 7.1 | 100.0 | 100.0 |

EXAMPLE FOUR ;p Flotation concentrates containing 32 grams/ton platinum, 17.5 grams/ton palladium and 7.8% $Cr_2O_3$ were mixed with lime, ferric oxide and carbon in the weight proportions 74/20/4/2 and heated in a high intensity gas fired furnace at 1500° C. A metal phase was separated from a slag phase and the weight distribution and assays of the products were as follows:

| | | Assays | | Distribution % | |
|---|---|---|---|---|---|
| Product | wt% | Pt g/t | Pd g/t | Pt | Pd |
| metal | 1.27 | 432 | 209 | 48.5 | 32.5 |
| slag | 98.73 | 5.9 | 5.6 | 51.5 | 67.5 |
| calc. head | 100.00 | 21.3 | 15.4 | 100.0 | 100.0 |

EXAMPLE FIVE

Figure 5:
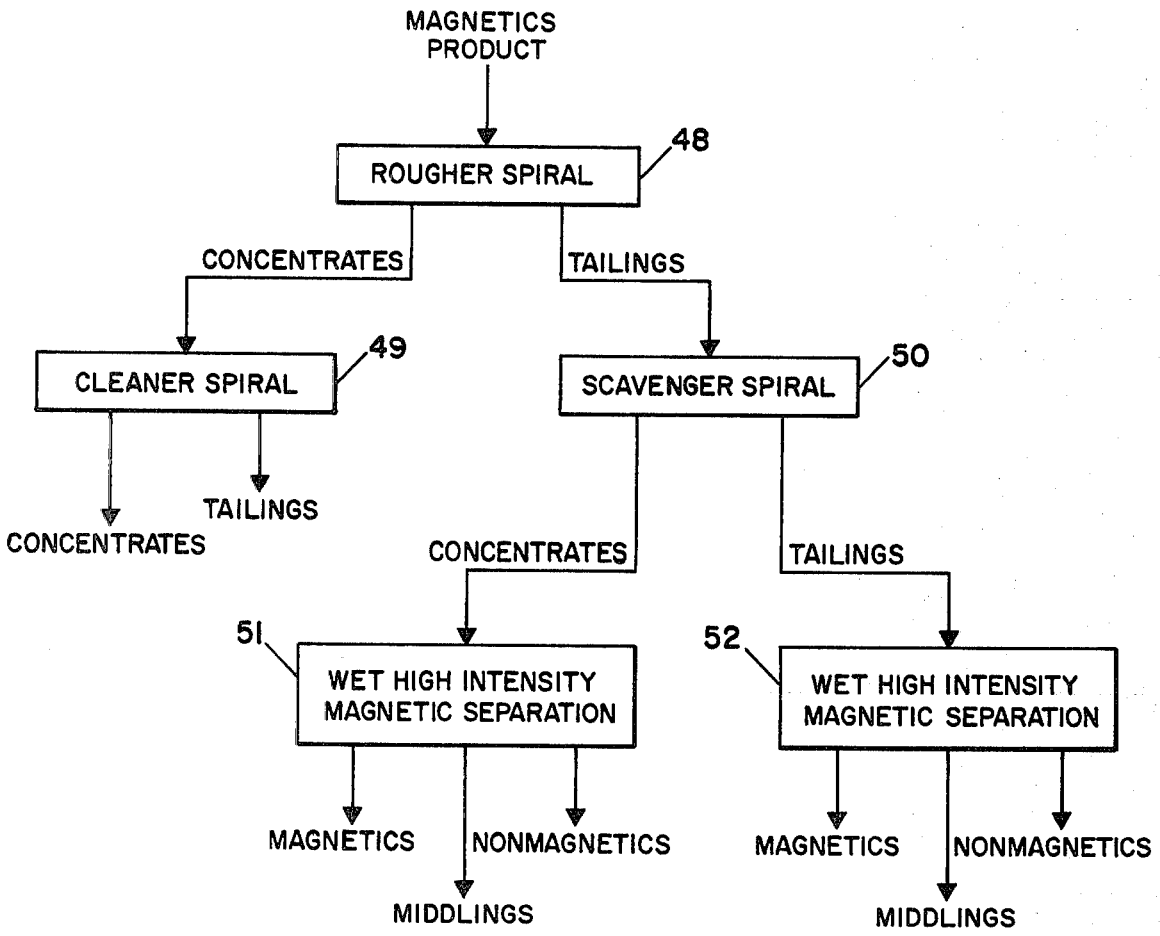
FIG. 5 is a schematic flowsheet of the spirals upgrading and wet high intensity magnetic separation described in Example 5.

Magnetics produced by wet high intensity magnetic separation of a South African ore in a pilot plant were processed on a batch basis by spirals and wet high intensity magnetic separator according to the flowsheet shown in FIG. 5. The magnetics product was fed to Rougher Spiral 48 at a feedrate of 1.2 tons per hour and about 35% solids by weight and the concentrates were fed to the Cleaner Spiral 49 to produce two products, concentrates and tailings. The mass and assay balances for the Rougher and Cleaner Spirals are as follows:

| ROUGHER SPIRAL | | | | | | | |
|---|---|---|---|---|---|---|---|
| | | Assays | | | Recoveries % | | |
| Product | wt% | $Cr_2O_3$% | Ptg/t | Pdg/t | $Cr_2O_3$ | Pt | Pd |
| concentrate | 76.4 | 40.49 | 0.6 | 0.3 | 82.1 | 43.7 | 44.7 |
| tailings | 23.6 | 28.59 | 2.5 | 1.2 | 17.9 | 56.3 | 55.3 |
| calculated head | 100.0 | 37.68 | 1.05 | 0.51 | 100.0 | 100.0 | 100.0 |
| assayed head | | 37.65 | 1.4 | 0.5 | | | |

| CLEANER SPIRAL | | | | | | | |
|---|---|---|---|---|---|---|---|
| | | Assays | | | Recoveries % | | |
| Product | wt% | $Cr_2O_3$% | Ptg/t | Pdg/t | $Cr_2O_3$ | Pt | Pd |
| concentrate | 89.1 | 41.97 | 0.6 | 0.3 | 92.0 | 66.2 | 69.0 |
| tailings | 10.9 | 29.71 | 2.5 | 1.1 | 8.0 | 33.8 | 31.0 |
| calculated head | 100.0 | 40.63 | 0.81 | 0.39 | 100.0 | 100.0 | 100.0 |
| assayed head | | 40.49 | 0.6 | 0.3 | | | |

In FIG. 3, the tailings from the Cleaner Spiral are comingled with the tailings from the Rougher Spiral and reground at 25 before separation on the scavenger Spiral. The assays tabulated above can be combined to indicate the grade and recovery of the chromite concentrate and the feed to the Scavenger Spiral 26 in Fig. Three.

| ROUGHER - CLEANER SPIRALS | | | | | | | |
|---|---|---|---|---|---|---|---|
| | | Assays | | | Recoveries % | | |
| Product | wt% | $Cr_2O_3$% | Ptg/t | Pdg/t | $Cr_2O_3$ | Pt | Pd |
| concentrates | 68.1 | 41.97 | 0.6 | 0.3 | 75.6 | 33.9 | 35.3 |
| tailings | 31.9 | 28.88 | 2.5 | 1.2 | 24.4 | 66.1 | 64.7 |
| calculated head | 100.0 | 37.79 | 1.2 | 0.6 | 100.0 | 100.0 | 100.0 |
| assayed head | | 37.65 | 1.4 | 0.5 | | | |

The tailings produced from Rougher Spiral 48 in Fig. Five was fed to a Scavenger Spiral 50 without regrind and the mass and assays of the products are tabled below.

| SCAVENGER SPIRALS | | | | | | | |
|---|---|---|---|---|---|---|---|
| | | Assays | | | Recoveries % | | |
| Product | wt% | $Cr_2O_3$% | Ptg/t | Pdg/t | $Cr_2O_3$ | Pt | Pd |
| concentrates | 49.2 | 25.83 | 2.6 | 1.2 | 44.8 | 50.2 | 49.2 |
| tailings | 50.8 | 30.84 | 2.5 | 1.2 | 55.2 | 49.8 | 50.8 |
| calculated head | 100.0 | 28.38 | 2.5 | 1.2 | 100.0 | 100.0 | 100.0 |
| assayed head | | 28.59 | 2.5 | 1.2 | | | |

These results show that regrind of the Scavenger feed is essential for liberation of chromite and platinum group metals from composite particles.

The two products from the Scavenger Spiral 50 were subjected to laboratory scale wet high intensity magnetic separation at a field strength of 1.5 tesla. The effect of regrinding was tested by grinding the spirals concentrate to 100% minus 80 microns and the spirals tailings was separated at the same conditions but without regrinding.

| SCAVENGER SPIRALS CONCENTRATES AFTER REGRIND | | | | | | | |
|---|---|---|---|---|---|---|---|
| | | Assays | | | Recoveries % | | |
| Product | wt% | $Cr_2O_3$% | Ptg/t | Pdg/t | $Cr_2O_3$ | Pt | Pd |
| magnetic | 66.3 | 35.35 | 1.1 | 0.6 | 82.6 | 27.7 | 32.7 |
| middlings | 3.0 | 12.91 | 6.0 | 2.7 | 1.4 | 6.8 | 6.7 |
| tailings | 30.7 | 14.35 | 5.6 | 2.4 | 16.1 | 65.4 | 60.6 |
| calculated head | 100.0 | 28.38 | 2.6 | 1.2 | 100.0 | 100.0 | 100.0 |

| SCAVENGER SPIRALS TAILINGS WITHOUT REGRIND | | | | | | | |
|---|---|---|---|---|---|---|---|
| | | Assays | | | Recoveries % | | |
| Product | wt% | $Cr_2O_3$% | Ptg/t | Pdg/t | $Cr_2O_3$ | Pt | Pd |
| magnetics | 71.1 | 34.96 | 2.0 | 0.9 | 81.2 | 48.3 | 47.4 |
| middlings | 3.5 | 21.55 | n.a.* | n.a.* | 2.5 | — | — |
| tailings | 25.4 | 19.71 | 6.0 | 2.8 | 16.4 | 51.7 | 52.6 |
| calculated head | 100.0 | 30.62 | 3.1 | 1.4 | 100.0 | 100.0 | 100.0 |

*n.a. insufficient sample for assay.

From these results, the advantage of regrinding the feed to the Scavenger Spiral may be clearly seen. In addition, it may be seen that additional recovery of chromite and platinum group metals is possible by processing the scavenger products by wet high intensity magnetic separation as shown at 22 in FIG. 3.

EXAMPLE SIX

Flotation concentrates containing 55 grams/ton platinum and 28 grams/ton palladium and 5.9% of $Cr_2O_3$ were mixed with lime, copper powder and charred coal containing 70% fixed carbon in weight proportions 70/25/2/3. The mixture was fed into a plasma arc furnace which contained a molten layer of 20 kilograms of copper metal. The furnace temperature was maintained at 1500°-1600° C. during the feeding of the mixture by controlling the electrical energy input and feedrate. At the conclusion of feeding 80 kilograms of the mixture the furnace was maintained at a temperature of 1550°-1650° C. for 30 minutes and then the slag and metal in the furnace were poured into ladles. After cooling the copper metal was separated from the slag and the platinum group metal was separated from the copper.

| | | Recoveries % | | | | | |
|---|---|---|---|---|---|---|---|
| Product | wt% | $Cr_2O_3$% | Ptg/t | Pdg/t | $Cr_2O_3$ | Pt | Pd |
| copper metal | 23.7 | 0.1 | 100 | 50 | 1 | 80 | 80 |
| slag | 76.3 | 4.1 | 7.8 | 3.9 | 99 | 20 | 20 |

What is claimed is:

1. A process for recovering platinum group metals from chromite-bearing ores, comprising the steps of:

(a) subdividing chromite-bearing ore containing one or more platinum group metals;

(b) subjecting a slurry of said subdivided ore to high intensity magnetic force to separate said ore into a magnetic fraction containing a substantial quantity of the chromite originally present in the ore and a non-magnetic fraction containing a substantial quantity of the platinum group metals originally present in the ore;

(c) subjecting said non-magnetic ore fraction containing a substantial quantity of the platinum group metals originally present in the ore to a flotation process to produce a concentrated fraction containing platinum group metals;

(d) smelting the concentrate in a high intensity heating furnace in the presence of one or more collector materials for the platinum group metals to produce a slag layer and collector material layer containing the platinum group metals in association with said collector metal;

(e) separating said collector material from said slag layers; and (f) separating platinum group metal from the collector material layer.

2. The process of claim 1 further comprising the step of treating said magnetic fraction produced in (b) to recover therefrom a product containing platinum group metals which were contained in said magnetic fraction, and adding said product to the non-magnetic ore fraction produced in (b).

3. The process of claim 2 wherein said treatment of the magnetic fraction comprises subjecting said magnetic fraction to gravity separation to produce a product containing platinum group metals which were contained in said magnetic fraction.

4. The process of claim 3 wherein said product is further treated for concentration of the platinum group metal content thereof prior to its addition to the non-magnetic ore fraction produced in (b).

5. The process of claim 4 wherein said further treatment of said product comprises subjecting said product to a process selected from the group consisting of flotation, wet high intensity magnetic separation and gravity separation.

6. The process of claim 1 wherein said non-magnetic ore fraction is deslimed prior to subjecting it to the flotation process of step (c).

7. The process of claim 1 wherein said smelting is conducted in the presence of one or more flux materials.

8. The process of claim 1 wherein said collector material is a metal selected from the group consisting of copper, nickel, iron, cobalt, lead, zinc and mixtures thereof.

9. The process of claim 1 wherein said collector material is an oxide or hydroxide of a metal selected from the group consisting of copper, nickel, iron, cobalt, lead, zinc and mixtures thereof, and wherein said smelting is conducted in the presence of a carbonaceous reductant capable of reducing said metal oxide or hydroxide to its corresponding metal.

10. The process of claim 1 wherein said collector material is mixed with the flotation concentrate produced in (c).

11. The process of claim 1 wherein said collector material is present in said high intensity heating furnace as a liquid layer prior to the introduction of the flotation concentrate produced in (c) thereto.

12. The process of claim 1 wherein the separation of platinum group metals from the collector material layer of step (f) comprises cooling said collector material layer, granulating said layer, dissolving said granulated collector material layer in acid and filtering said dissolved layer to remove therefrom precipitated and suspended platinum group metals.

13. The process of claim 12 wherein said dissolved layer, after filtering, is subjected to electrolysis to recover therefrom collector material and other metals if present.

14. The process of claim 1 wherein the separation of platinum group metals from the collector material layer of step (f) comprises subjecting said layer to electrolysis to remove collector material.

15. The process of claim 1 further comprising the step of treating said slag layer to recover collector material and platinum group metals associated therewith.

16. The process of claim 1 wherein said high intensity heating furnace of step (d) is a plasma arc furnace.

17. A process for recovering platinum group metals from chromite-bearing ores, comprising the steps of:

(a) comminuting chromite-bearing ore containing one or more platinum group metals;

(b) subjecting a slurry of said comminuted ore to high intensity magnetic force to separate the ore into a magnetic fraction containing a substantial portion of the chromite originally present in the ore and a nonmagnetic fraction containing a substantial portion of the platinum group metals originally present in the ore;

(c) subjecting the said magnetic ore fraction to a gravity separation process to produce a concentrates fraction containing chromite and a gravity tailings fraction containing a substantial portion of the platinum group metals present in the magnetic ore fraction;

(d) subjecting the gravity tailings fraction to a process selected from the group consisting of magnetic separation, flotation and gravity separation to concentrate the platinum group metals present in the gravity tailings;

(e) subjecting the nonmagnetic ore fraction of (b) containing a substantial portion of the platinum group metals originally present in the ore together with concentrates containing platinum group metals produced in (d) to a flotation process to produce a concentrated fraction containing platinum group metals;

(f) smelting the flotation concentrate in a high intensity eating furnace in the presence of one or more collector metals for the platinum group metals to produce a slag layer and a metal layer containing the platinum group metals in association with the said collector metal;

(g) separating said metal layer from said slag layer; and (h) separating platinum group metals from the metal layer.

18. The process of claim 17 wherein said non-magnetic ore fraction of step (b) together with concentrates containing platinum group metals produced in step (d) is deslimed prior to subjecting it to flotation in step (e), and wherein the recovered slimes are mixed with said flotation concentrate prior to smelting thereof in step (f).

* * * * *